US010094013B2

(12) United States Patent
Nasserrafi et al.

(10) Patent No.: US 10,094,013 B2
(45) Date of Patent: Oct. 9, 2018

(54) METHOD TO PREVENT ABNORMAL GRAIN GROWTH FOR BETA ANNEALED TI-6AL-4V FORGINGS

(71) Applicant: Spirit AeroSystems, Inc., Wichita, KS (US)

(72) Inventors: Rahbar Nasserrafi, Andover, KS (US); Gerald E. Hicks, Wichita, KS (US); Michael A. Walker, Wichita, KS (US); Craig M. Clasper, Derby, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 434 days.

(21) Appl. No.: 14/972,972

(22) Filed: Dec. 17, 2015

(65) Prior Publication Data

US 2017/0175241 A1 Jun. 22, 2017

Related U.S. Application Data

(60) Provisional application No. 62/069,079, filed on Dec. 23, 2014.

(51) Int. Cl.

| | |
|---|---|
| ***C22F 1/18*** | (2006.01) |
| ***C22F 1/02*** | (2006.01) |
| ***C22C 14/00*** | (2006.01) |

(52) U.S. Cl.

CPC ..... *C22F 1/183* (2013.01); *C22C 14/00* (2013.01); *C22F 1/02* (2013.01)

(58) Field of Classification Search

None

See application file for complete search history.

(56) References Cited

U.S. PATENT DOCUMENTS

| | | | | |
|---|---|---|---|---|
| 4,902,355 | A * | 2/1990 | Jaffee | C21D 1/667 148/670 |
| 2007/0251614 | A1* | 11/2007 | Bhambri | A61L 27/06 148/669 |
| 2016/0168680 | A1* | 6/2016 | Glavicic | C22F 1/183 148/669 |

* cited by examiner

*Primary Examiner* — George Wyszomierski

(74) *Attorney, Agent, or Firm* — Hovey Williams LLP

(57) ABSTRACT

A method for heat-treating a titanium alloy, such as Ti-6Al-4V. The method may occur after or include a step of forging the titanium alloy such that localized, highly deformed grains are formed in the titanium alloy. Then the method may include steps of recrystallization annealing the titanium alloy by heating the titanium alloy to a temperature in a range between 30° F. to 200° F. below beta transus of the titanium alloy for 1 hour to 6 hours and then furnace cooling of the titanium alloy to 1200° F. to 1500° F. at a rate of 50° F. to 500° F. per hour. Following the recrystallization annealing, the method may include beta annealing the titanium alloy. These steps may be performed in a single heat treating cycle.

19 Claims, 3 Drawing Sheets

METHOD TO PREVENT ABNORMAL GRAIN GROWTH FOR BETA ANNEALED TI-6AL-4V FORGINGS

RELATED APPLICATIONS

This nonprovisional patent application claims priority benefit, with regard to all common subject matter, of earlier-filed U.S. provisional patent application titled "A Method to Prevent Abnormal Grain Growth For Beta Annealed TI-6AL-4V Forgings", Ser. No. 62/096,079, filed Dec. 23, 2014, hereby incorporated by reference in its entirety into the present application.

BACKGROUND

Titanium forging is a manufacturing process involving the shaping of titanium metal using localized compressive forces and heat. Major quality problems may occur during titanium forging due to abnormal grain growth (AGG) within forgings after a final heat treatment. This problem may be observed with any beta annealed forging. No prior art method exists to salvage such parts past the billetizing process.

Beta annealed forgings experience this problem because of significant cumulative reduction in area, from the ingot to billet and from the billet to the finished working, creating a significant amount of localized plastic deformation within the forging volume. For applications requiring beta annealing to achieve enhanced damage tolerance and fracture toughness, Ti-6Al-4V forgings are often heated to above the beta transus of the material and held for sufficient time to transform the alloy microstructure within the forging from a mixture of alpha and beta phases into a singular phase (beta) phase at solution heat treatment temperature. The forging is subsequently cooled at prescribed cooling rates, for example, rates equivalent to air cooling for beta annealing, or faster cooling rates such as that of water quenching for beta solution treated application. Upon cooling to room temperature, the forging can then be stabilized, or alternatively aged or over-aged to achieve a final temper. In this case, the final temper is beta anneal, which includes stabilization to achieve a good combination of strength and damage tolerance.

When too much cumulative hot work is performed during the reduction of the alloy from ingot to the final shape within the alpha-beta forging temperatures, the grains can become highly deformed, and the amount of deformation might not be uniformly distributed within the forging. The uneven strain distribution and the high levels of stored strain energy within the forging, upon subsequent beta annealing heat treatment and shortly after the temperature exceeds the beta transus, can result in accelerated grain growth at the zones with the highest level of plastic strain at the expense of a more copious, and uniform nucleation of new grains. Forgings with microstructures consisting of non-uniform transformed grain size can greatly degrade mechanical properties and durability of the resultant forgings, with fatigue crack initiation and possibly propagation being the most affected.

FIG. 1 shows a typical prior art beta annealed Ti-6Al-4V forged macrostructure exhibiting both fine grains at the periphery and very coarse grains in the middle of the forged billet. The forging pictured had undergone more than 6×-8× reduction prior to beta anneal. The excessive plastic deformation resulted in significant driving force for grain growth in the middle of the forging.

SUMMARY

Embodiments of the present invention solve the above-mentioned problems and provide a distinct advance in the art of heat treating titanium forgings.

One embodiment of the invention is a method for heat-treating a titanium alloy. The method may include the steps of recrystallization annealing the titanium alloy, then beta annealing the titanium alloy. The recrystallization annealing may include heating the titanium alloy to a temperature 30° F. to 200° F. below beta transus of the titanium alloy for a length of time in the range of 1 hour to 6 hours followed by slow cooling the titanium alloy after to 1200° F. to 1500° F. at a rate of 50° F. to 500° F. per hour.

Another embodiment of the invention is a method for heat-treating a titanium alloy, where the titanium alloy is Ti-6Al-4V. The method may include the steps of recrystallization annealing the titanium alloy by heating the titanium alloy to a temperature in a range between 30° F. to 200° F. below beta transus of the titanium alloy for 1 hour to 6 hours, then furnace cooling of the titanium alloy to 1200° F. to 1500° F. at a rate of 50° F. to 500° F. per hour. Next, the method may include a step of beta annealing the titanium alloy, which may include heating the titanium alloy to a temperature above beta transus of the titanium alloy. Specifically, beta annealing the titanium alloy may include heating the titanium alloy to a temperature in the range of 10° to 100° F. above the beta transus of the titanium alloy for 15 minutes to 5 hours.

In yet another embodiment of the invention, a method for heat-treating a titanium alloy, where the titanium alloy is Ti-6Al-4V, may first include a step of forging of the titanium alloy such that localized, highly deformed grains are formed in the titanium alloy. Next, the method may include a step of recrystallization annealing the titanium alloy. The recrystallization annealing may include heating and holding the titanium alloy at a temperature in a range between 30° F. to 200° F. below beta transus of the titanium alloy for a length of time in a range of 1 to 4 hours following the forging step. The beta transus of the titanium alloy may be a temperature between 1800° F. and 1850° F. Then the recrystallization step may further include the steps of furnace cooling of the titanium alloy to 1200° F. to 1500° F. at a rate of 50° F. to 500° F. per hour. The recrystallization annealing may result in the highly deformed grains forming fine and uniform transformed beta grains throughout the titanium alloy. Next, the method may include beta annealing the titanium alloy by reheating then holding the titanium alloy at the temperature in the range between 30° F. to 200° F. below beta transus of the titanium alloy and heating, followed by holding the titanium alloy at a temperature above beta transus of the titanium alloy for an amount of time between 15 minutes to 5 hours.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the current invention are described in detail below with reference to the attached drawing figures, wherein.

Figure 3:
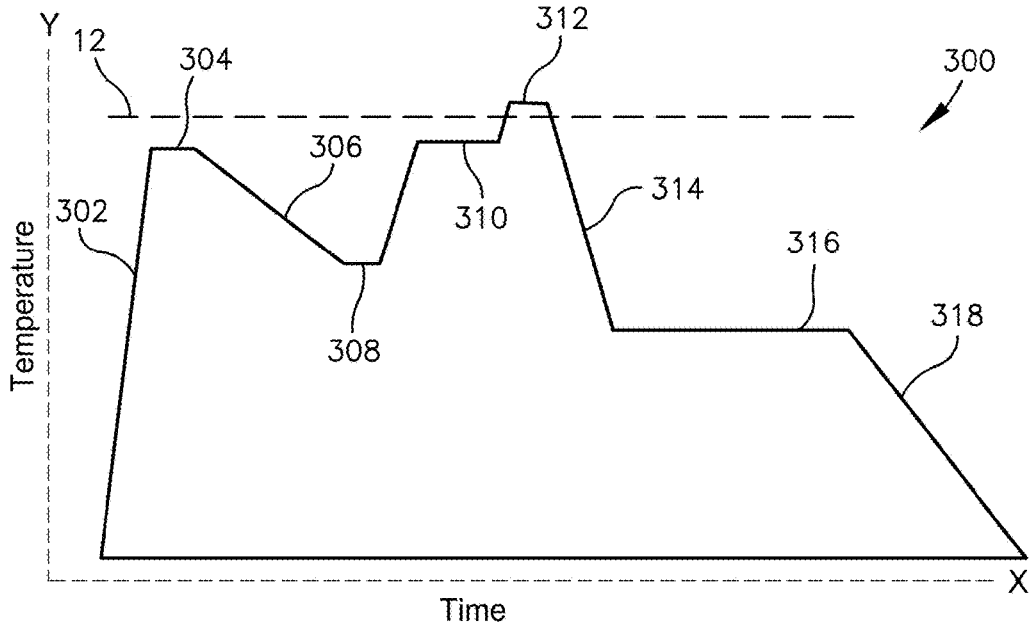
FIG. 3 is a chart of a titanium heat treatment method according to various embodiments of the present invention, illustrating time versus temperature used.
Figure 4:
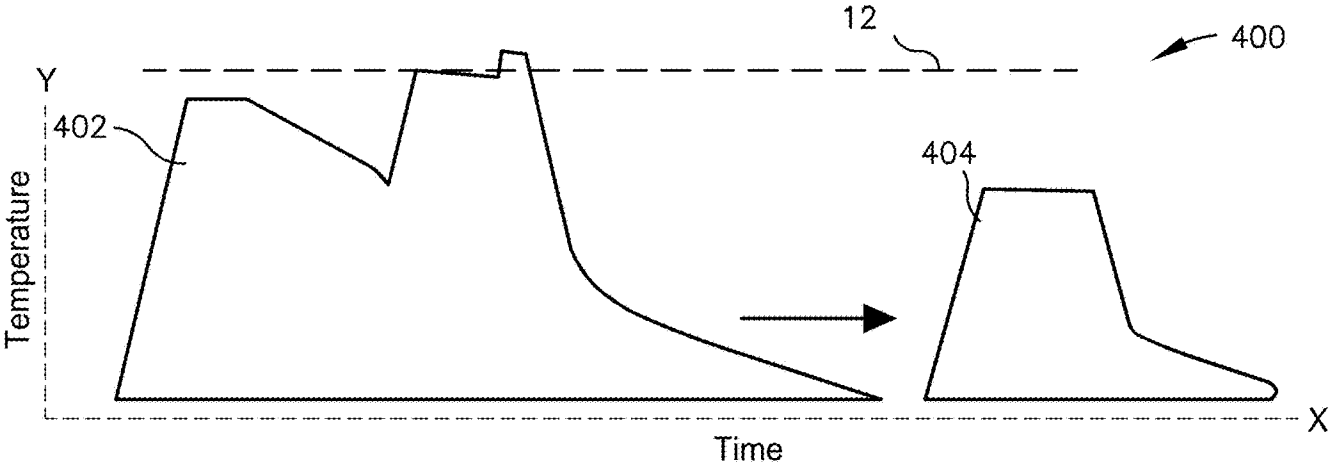
Figure 5:
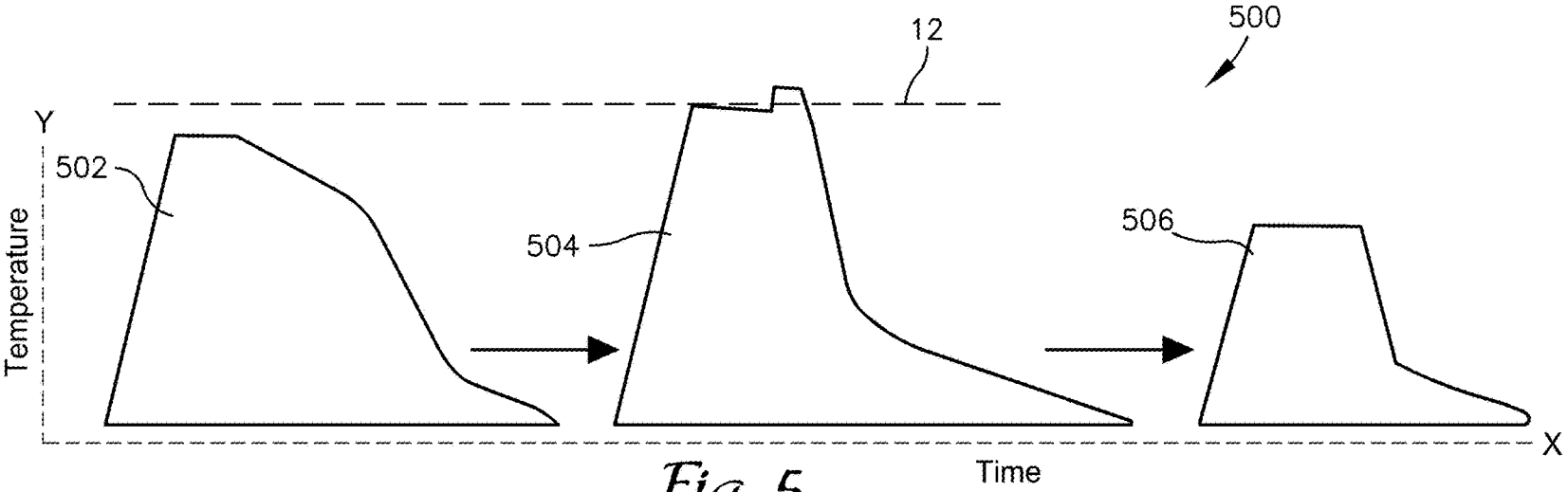

FIG. 4 is a chart of an alternative embodiment of the titanium heat treatment method according to various embodiments of the present invention and illustrating breaking the method of FIG. 3 into two cycles; and FIG. 5 is a chart of another alternative embodiment of the titanium heat treatment method according to various embodiments of the present invention and illustrating breaking the method of FIG. 3 into three cycles.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 1:
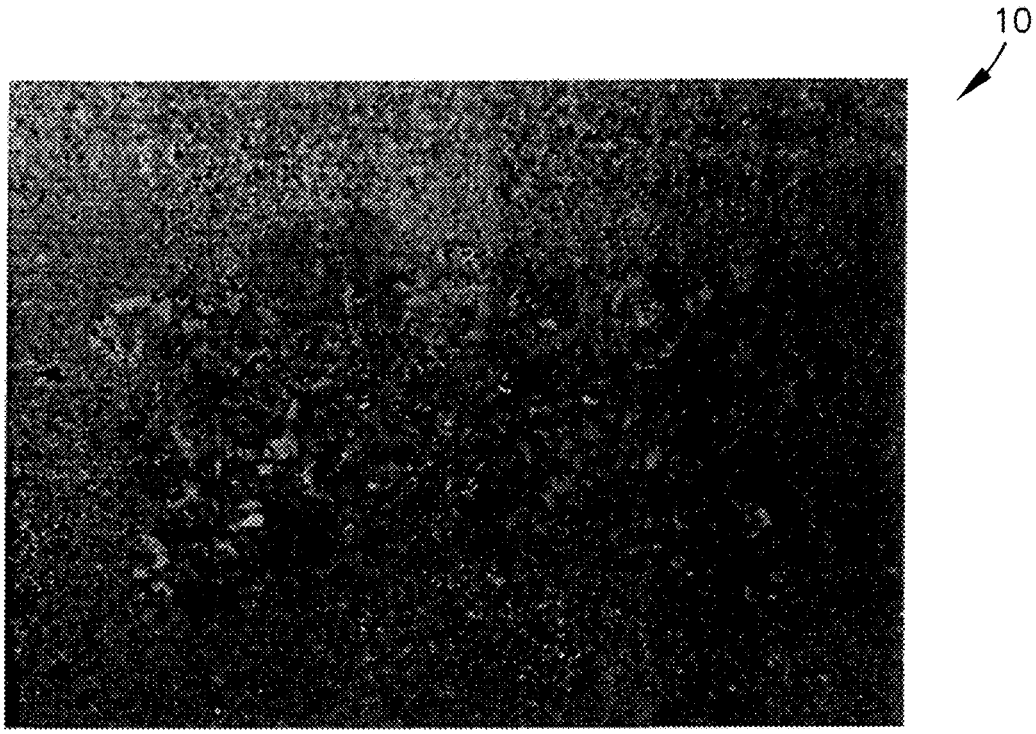
FIG. 1 is a photograph of macrostructure of beta annealed titanium (Ti-6Al-4V) forging with high degrees of deformation prior to beta annealed heat treatment.

The present invention is a method of heat treating a titanium alloy 10, as pictured in FIG. 1, to be used for any fracture toughness or damage tolerant applications from fuselage door frames to pylon structures. The titanium alloy 10 may be, for example, Ti-6Al-4V (grade 5 titanium).

The methods described herein for heat treating the titanium alloy 10 may use any number of heat sources, heating devices, and/or heat-treating systems known in the art of titanium forging. For example, vacuum furnaces (not shown) or inert gas (e.g., argon) cover may be used for heat treating of the titanium alloy 10. Alternatively, one or more of the steps described below may be performed in electric or gas furnaces. However, parts heat treated in a non-inert or non-vacuum environment may require chemical milling to remove alpha phase formed as oxygen/nitrogen atoms diffuse into surfaces of the titanium alloy 10, causing a very hard and brittle surface layer that needs to be removed before use of the heat-treated titanium alloy 10.

The vacuum furnaces may use sealed chambers and electric heating elements to heat the titanium alloy 10. Gas furnaces may use a retort that is purged with argon to seal an inside of the retort where the titanium alloy 10 is located from reacting with combustion gases from the gas furnace. Air electric ovens may also be used if alpha case will be removed in a separate step via machining or chemical milling.

Figure 2:
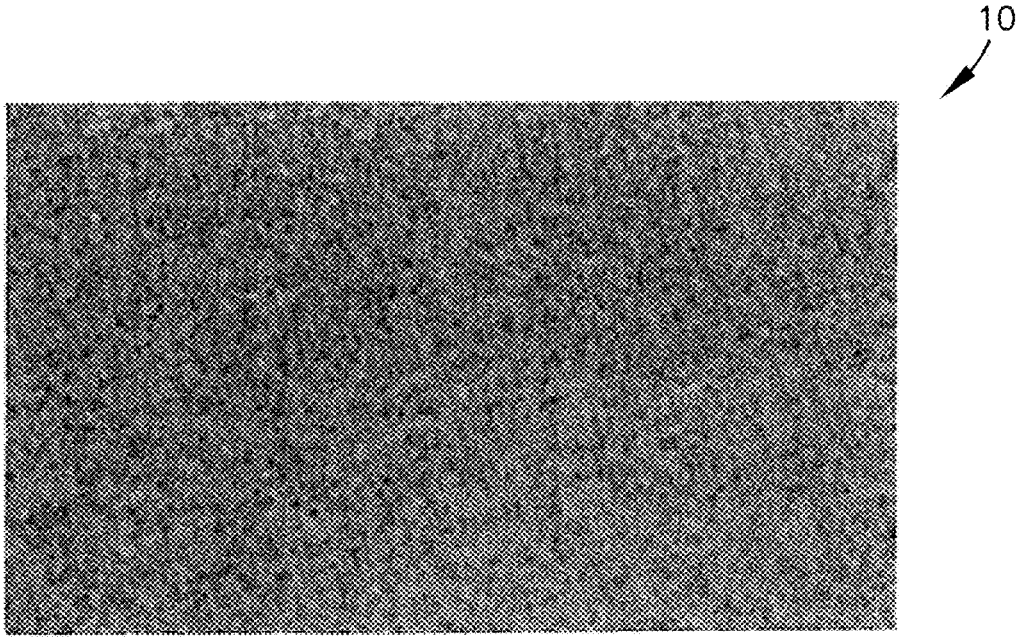
FIG. 2 is a photograph of macrostructure of beta annealed titanium (Ti-6Al-4V) forging with lower level of deformation prior to beta anneal heat treatment, including fine, uniform grain structure.

The methods described herein avoid formation of abnormally coarse grains 12, as pictured in FIG. 1, caused by excessive work performed in an alpha-beta processing window or alpha-beta processing temperature range during forging of the titanium alloy 10. The methods of the present invention can advantageously result in relatively fine and uniform transformed beta grains throughout the forging thickness of the titanium alloy 10, as pictured in FIG. 2, regardless of the severity of cumulative plastic deformation introduced at any stage of forging.

Specifically, the methods of the present invention add a controlled alpha-beta recrystallization step, referred to herein as recrystallization annealing, prior to a final beta anneal heat treatment, referred to herein as beta annealing, in order to promote recrystallization and nucleation of copious new grains from highly deformed grains formed when the titanium alloy 10 was forged (deformed) extensively in an alpha-beta temperature range (e.g., approximately 1650° F. to 1770° F.). The benefit of this intermediate recrystallization annealing step prior to the final beta annealing heat treatment is that this recrystallization takes place below a beta transus of the titanium alloy 10, where the presence of primary alpha phase acts as a natural obstacle/barrier to the otherwise unrestricted and rapid growth of the beta grains if the recrystallization was to take place above the beta transus. The "Beta transus" is represented by reference numeral 12 in FIGS. 3-5 and may be defined herein as a lowest temperature at which a 100-percent beta phase can exist for the titanium alloy 10. The beta transus of the titanium alloy 10 can range from 1,300° F. (700° C.) to as high as 1,900° F. (1,050° C.), depending on alloy composition. In general, the beta transus of Ti-6Al-4V (grade 5 titanium) is approximately 1800° F. to 1850° F.

The chart of FIG. 3 depicts the steps of an exemplary method 300 for heat treatment of the titanium alloy 10 according to one embodiment of the present invention, with an x-axis representing time and a y-axis representing temperature. The steps of the method 300 may be performed in the order shown, or they may be performed in a different order. In addition, some steps may not be performed or may be separated in time by other intermediate steps not depicted.

The method 300 may first include a step of recrystallization annealing. The recrystallization annealing may occur, for example, after finish forging or die forging of the titanium alloy 10, and prior to beta annealing thereof. Specifically, recrystallization annealing may include the individual steps of ramping up to a temperature below beta transus, as depicted with line 302, and stabilizing or holding the temperature at approximately 30°-200° F. below beta transus, as depicted with line 304. Specifically, step 304 may include exposing the titanium alloy to a temperature in a range of 1650° F. to 1770° F. or a temperature in a range of 1675° F. to 1725° F. for 1 hour to 6 hours or for 1 hour to 4 hours.

Following step 304, the recrystallization annealing may further include a step of slow cooling or furnace cooling the titanium alloy 10 to a stabilization temperature, as depicted with line 306, and optionally stabilizing or holding the temperature at that stabilization temperature for a short amount of time, as depicted with line 308. Specifically, this stabilization temperature may be in a range of 1000° F. to 1500° F., in a range of 1200° F. to 1500° F., in a range of 1300° F. to 1500° F., in a range of 1350° F. to 1450° F., and/or in a range of 1375° F. to 1425° F. This cooling may be performed at a rate between 50° F. to 500° F. per hour, between 50° F. to 250° F. per hour, or between 75° F. to 125° F. per hour, depending on a thickness of the titanium alloy, requirements related to uses of the titanium alloy, and other characteristics of the titanium alloy.

Following the slow cooling or furnace cooling step, the method 300 may include a step of beta annealing, which may specifically include the steps of ramping up and holding (soaking) the titanium alloy 10 to a temperature slightly below beta transus, as depicted with line 310, then heating the titanium alloy 10 to above beta transus and holding at that temperature for a limited time, as depicted with line 312. The temperature slightly below beta transus may be 25° F. to 75° F. below beta transus in step 310, or alternatively between 30° to 200° F. below beta transus. The temperature above beta transus may be in a range of 10° F. to 100° F. above beta transus or in a range of 25° to 45° F. The titanium alloy 10 in step 312 may be held at the temperature above beta transus for a length of time corresponding to a thickness of the titanium alloy 10, such as approximately 30 minutes per inch of thickness of the titanium alloy 10. Thus, a range of time at which the titanium alloy 10 is held above beta transus during the beta annealing step may be in a range of approximately 15 minutes to 5 hours.

Next, the method 300 may include the steps of cooling and stabilizing the temperature of the titanium alloy 10 back to the stabilization temperature for adequate time, as depicted with lines 314 and 316. The cooling of step 314 may be accomplished via air cooling or any method known in the art to cool the titanium alloy 10 down to a temperature of approximately 1200° F. to 1450° F. and then holding or stabilizing the titanium alloy 10 at that temperature for approximately 2 hours or 3-4 hours. Finally, the method 300 may include a step of cooling the titanium alloy 10 down to room temperature, as depicted with line 318.

Note that the method 300 in FIG. 3 illustrates a sustained heating at or above the stabilization temperature throughout the heat treating process until the final step of returning to room temperature. This is an example of the heat treating occurring in one cycle. However, in one alternative embodiment of the invention, a method 400, as illustrated in FIG. 4, depicts the heat treatment being broken into two separate heat treating cycles. A first cycle 402 includes both the recrystallization annealing and the beta annealing, as described in steps 302-312 above. Following the first cycle 402, the titanium alloy 10 may be cooled back to room temperature. Next, a second cycle 404 may include heating the titanium alloy 10 back up to the stabilization temperature. For example, the second stage 404 may include the steps 314-318 described above.

In yet another alternative embodiment of the invention, a method 500, as illustrated in FIG. 5, depicts the heat treatment being broken into three separate heat treating cycles. Specifically, a first cycle 502 may include recrystallization annealing, such as in steps 302-306 above, a second cycle 504 may include beta annealing, such as in steps 310 and/or 312 above, and a third cycle 506 may include stabilization, such as in steps 314-318 above. Between each of these three separate cycles, the titanium alloy 10 may return to room temperature.

In the present invention, when recrystallization is performed below the beta transus, the excessive strain energy, which acts as the driving force for grain growth in areas with the highest levels of pre-existing plastic strain, is mainly consumed by nucleation of copious new grains in place of rapid growth of fewer grains. During the recrystallization annealing, many finer new grains are formed from highly deformed grains and the driving force for grain growth in the form of the excessive strain energy is consumed. Recrystallization annealing of new grains below the beta transus just prior to the final beta annealing heat treatment will promote the nucleation of new grains at the expense of rapid grain growth. Subsequent beta anneal will then fully transform the grains into transformed beta grains.

Advantageously, the tendency for abnormal grain growth can be effectively eliminated or minimized with the methods described herein. Specifically, the methods described herein eliminate the root causes of abnormal grain growth without the need for new dies or extra beta anneal cycles. The methods herein also eliminate the risk of nonconforming titanium products due to excessive hydrogen or scaling due to repeate3d beta cycles experienced with conventional methods.

Although the invention has been described with reference to the embodiments illustrated in the attached drawing figures, it is noted that equivalents may be employed and substitutions made herein without departing from the scope of the invention.

The invention claimed is:

1. A method for heat-treating a titanium alloy, the method comprising the steps of:

recrystallization annealing the titanium alloy, wherein recrystallization annealing comprises heating the titanium alloy to a temperature 30° F. to 200° F. below beta transus of the titanium alloy for a length of time in a range of 1 hour to 6 hours followed by slow cooling the titanium alloy after to 1200° F. to 1500° F. at a rate of 50° F. to 500° F. per hour; and beta annealing the titanium alloy following completion of the recrystallization annealing steps including heating the titanium alloy to a temperature in a range of 10° to 100° F. above the beta transus of the titanium alloy.

2. The method of claim 1, wherein the beta annealing comprises holding the temperature above beta transus for 30 minutes per inch of thickness of the titanium alloy.

3. The method of claim 1, wherein the beta annealing further comprises holding the temperature in the range of 10° to 100° F. above beta transus for 15 minutes to 5 hours.

4. The method of claim 1, wherein beta transus of the titanium alloy is a temperature between 1800° F. and 1850° F.

5. The method of claim 1, further comprising forging of the titanium alloy prior to the recrystallization annealing step.

6. The method of claim 1, wherein the titanium alloy is Ti-6Al-4V.

7. The method of claim 1, wherein the step of slow cooling the titanium alloy comprises furnace cooling the titanium alloy.

8. The method of claim 1, further comprising a step of gradually heating then holding the titanium alloy at a temperature 30° F. to 200° F. below beta transus of the titanium alloy following the slow cooling of the recrystallization annealing step and immediately preceding the step of beta annealing.

9. The method of claim 8, further comprising the steps of cooling the titanium alloy to a stabilization temperature between 1200° F. to 1450° F. for one or more hours following the beta annealing step and then cooling the titanium alloy to room temperature.

10. A method for heat-treating a titanium alloy, wherein the titanium alloy is Ti-6Al-4V, the method comprising the steps of:

recrystallization annealing the titanium alloy by heating the titanium alloy to a temperature in a range between 30° F. to 200° F. below beta transus of the titanium alloy for 1 hour to 6 hours and then furnace cooling of the titanium alloy to 1200° F. to 1500° F. at a rate of 50° F. to 500° F. per hour; and beta annealing the titanium alloy following the furnace cooling step, wherein the beta annealing comprises heating the titanium alloy to a temperature in the range of 10° to 100° F. above beta transus of the titanium alloy for 15 minutes to 5 hours.

11. The method of claim 10, wherein the beta annealing further comprises holding the temperature above beta transus for 30 minutes per inch of thickness of the titanium alloy.

12. The method of claim 10, wherein beta transus of the titanium alloy is a temperature between 1800° F. and 1850° F.

13. The method of claim 10, further comprising steps of forging of the titanium alloy prior to the recrystallization annealing step.

14. The method of claim 10, further comprising a step of heating then holding the titanium alloy at a stabilization temperature of between 1200° F. to 1450° F. following the step of furnace cooling and immediately preceding the step of beta annealing.

15. The method of claim 10, further comprising the steps of cooling the titanium alloy to a stabilization temperature between 1200° F. to 1450° F. for one or more hours following the beta annealing step and then cooling the titanium alloy to room temperature.

16. The method of claim 10, wherein the recrystallization annealing includes holding the titanium alloy at the temperature in the range of 30° F. to 200° F. below beta transus of the titanium alloy for a length of time in a range of 1 hour to 4 hours.

17. A method for heat-treating a titanium alloy, wherein the titanium alloy is Ti-6Al-4V, the method comprising the steps of:

forging of the titanium alloy such that localized, highly deformed grains are formed in the titanium alloy;

recrystallization annealing the titanium alloy by heating and holding the titanium alloy at a temperature in a range between 30° F. to 200° F. below beta transus of the titanium alloy for a length of time in a range of 1 to 4 hours following the forging step, then furnace cooling the titanium alloy to 1200° F. to 1500° F. at a rate of 50° F. to 500° F. per hour, wherein beta transus of the titanium alloy is a temperature between 1800° F. and 1850° F., wherein the recrystallization annealing results in the highly deformed grains forming fine and uniform transformed beta grains throughout the titanium alloy; and beta annealing the titanium alloy following the furnace cooling, wherein the beta annealing comprises:

reheating then holding the titanium alloy at the temperature in the range between 30° F. to 200° F. below beta transus of the titanium alloy, and heating then holding the titanium alloy at a temperature above beta transus of the titanium alloy for an amount of time between 15 minutes to 5 hours.

18. The method of claim 17, further comprising the steps of cooling the titanium alloy to a stabilization temperature between 1200° F. to 1450° F. for one or more hours following the beta annealing step and then cooling the titanium alloy to room temperature.

19. The method of claim 17, wherein the beta annealing further comprises holding the temperature in a range of 10° to 100° F. above the beta transus for 30 minutes per inch of thickness of the titanium alloy.

* * * * *